US008136447B2

(12) United States Patent
Gochenauer et al.

(10) Patent No.: US 8,136,447 B2
(45) Date of Patent: Mar. 20, 2012

(54) DECORATIVE ARTICLES AND PRINTING REGISTRATION METHOD

(75) Inventors: William C. Gochenauer, Columbia, PA (US); James R. Baxter, Millersville, PA (US); Ann M. Murdoch, Columbia, PA (US)

(73) Assignee: AWI Licensing Company, Wilmington, DE (US)

( * ) Notice: Subject to any disclaimer, the term of this patent is extended or adjusted under 35 U.S.C. 154(b) by 537 days.

(21) Appl. No.: 12/330,072

(22) Filed: Dec. 8, 2008

(65) Prior Publication Data

US 2009/0145313 A1 Jun. 11, 2009

Related U.S. Application Data

(60) Provisional application No. 61/005,619, filed on Dec. 6, 2007.

(51) Int. Cl.
*B41M 1/12* (2006.01)

(52) U.S. Cl. ..... 101/129; 101/486

(58) Field of Classification Search ..... 101/114, 101/123, 126, 485, 486, DIG. 36, 129; 33/614, 33/617, 619, 620, 621
See application file for complete search history.

(56) References Cited

U.S. PATENT DOCUMENTS

| | | | | |
|---|---|---|---|---|
| 3,098,431 | A | 7/1963 | Weaver | |
| 3,513,775 | A * | 5/1970 | Guthrie | 101/129 |
| 3,834,348 | A | 9/1974 | Black | |
| 3,943,851 | A | 3/1976 | Inada et al. | |
| 4,137,842 | A | 2/1979 | Miller | |
| 4,286,518 | A | 9/1981 | Ottofer, Jr. | |
| 4,362,808 | A | 12/1982 | Otthofer, Jr. | |
| 4,440,080 | A | 4/1984 | Lyall | |
| 4,911,070 | A | 3/1990 | Miske et al. | |
| 5,094,160 | A | 3/1992 | Jennings | |
| 5,127,321 | A | 7/1992 | Proffer | |
| 5,129,155 | A | 7/1992 | Hoffman et al. | |
| 5,168,805 | A | 12/1992 | Kasanami et al. | |
| 5,188,026 | A | 2/1993 | Fuqua et al. | |
| 5,226,366 | A | 7/1993 | Schlife et al. | |
| 5,241,187 | A | 8/1993 | Ikeda et al. | |
| 5,509,964 | A | 4/1996 | Boaz | |
| 5,517,912 | A | 5/1996 | Winter | |
| 5,847,689 | A * | 12/1998 | Elliot | 345/634 |
| 6,743,327 | B2 | 6/2004 | Schober | |
| 7,008,700 | B1 | 3/2006 | Goodson et al. | |
| 2004/0247801 | A1 | 12/2004 | Schober | |

* cited by examiner

*Primary Examiner* — Ren Yan

(57) ABSTRACT

A decorative article having a substrate with two opposing viewable surfaces. Each viewable surface has a screen print thereon which, in combination, provides a decorative article having a three-dimensional visual. Also, a method of registering the screen prints is provided. The method ensure that two or more panels having the same designs printed thereon are consistent with one another.

9 Claims, 9 Drawing Sheets

DECORATIVE ARTICLES AND PRINTING REGISTRATION METHOD

CROSS REFERENCE TO RELATED APPLICATION

This application claims the benefit under 35 U.S.C. §119 (e) of U.S. provisional application Ser. No. 61/005,619, filed Dec. 6, 2007.

BACKGROUND OF THE INVENTION

This present invention relates generally to decorative articles. More specifically, the invention relates to translucent or semi-transparent polymer substrates and to the registration of images printed thereon to produce three dimensional visuals.

There is an increasing use in the interior building environment on the use of transparent or translucent substrates which can be used to accent interior building spaces. In particular, polymer substrates are particularly popular as they can be manufactured to have the same appearance as glass but are: lighter in weight; more resilient and flexible; and can be produced with less cost. Materials generally used for creating these polymer substrates include polycarbonate, polyvinyl chloride or "PVC", poly(methylmethacrylate) or "PMMA" and poly(ethylene-co-cyclohexane 1,4-dimethanol terephthalate) or "PETG".

From an aesthetics standpoint, it is also desired to create decorative articles having a three-dimensional, or 3-D, visual. Conventional attempts include embedding objects inside a translucent or semi-transparent glass or polymeric substrate. As a result, the embedded objects can be viewed through the various surfaces of the substrate, each providing a three-dimensional visual. Unfortunately, embedding objects inside the substrate is not ideal in terms of the manufacturing complexity and the cost associated therewith. Other known attempts include etching a design onto opposing viewable surfaces of a substrate. Unfortunately, the etching technique is also not ideal in terms of the manufacturing complexity and cost.

Accordingly, an advantage in the art of 3-D decorative articles can be realized by utilizing a refinement of known print screen stencil techniques.

BRIEF SUMMARY OF THE INVENTION

The present invention is a decorative article which provides a three-dimensional visual. The decorative article includes a polymer substrate, herein also referred to as a polymer structure, having two opposing viewable surfaces. An object having opposing viewable surfaces as used herein refers to an object having two surfaces wherein that which is printed on one of the surfaces can be at least partially, if not entirely, viewed when viewing the object through the other surface. Each of the two viewable surfaces includes a decorative print which, in combination, provides a 3-D visual.

The present invention also includes a method of registering the decorative prints to provide a consistent printed image, and, in turn, a consistent 3-D visual. The method includes the steps of: providing a substrate which has a first surface, a second surface and an edge surface extending therebetween; arranging the substrate on a stationary screen supporting structure such that the second surface of the substrate faces the supporting structure; positioning a registration frame proximate the edge surface of the substrate; securing the registration frame to the supporting structure; positioning a first print screen stencil having two or more registration holes above the substrate and registration frame such that at least two registration holes are aligned with the registration frame; applying a printing composition to the first print screen stencil to produce a printed design on the first surface of the substrate as well as at least two print screen stencil registration marks on the registration frame; removing the first print screen stencil from above the first surface of the substrate; turning the substrate over so that the first surface of the substrate faces the supporting structure; positioning a second print screen stencil having two or more registration holes on top of the substrate and registration frame such that at least two registration holes of the second print screen stencil are aligned with the at least two print screen stencil registration marks on the registration frame; and applying a printing composition to the second print screen stencil to produce a printed design on the second surface of the polymer substrate.

Several advantages can be realized over current three-dimensional decorative substrates. For example, the decorative polymer substrates of the invention are easier to manufacture and can be manufactured at a lower cost. In addition, the 3-D visual can be achieved with greater consistency, which, in turn, will eliminate differences in the appearance of two or more substrates positioned proximate one another. Further, the thickness of the substrate is not in any way controlled by the dimensions of an object as is the case when object are embedded in the substrate. Also, the use of the registration method of the invention provides rapid printing of multiple substrates while providing the aforementioned consistent three-dimensional visual.

DETAILED DESCRIPTION OF THE DRAWINGS

Figure 1A:
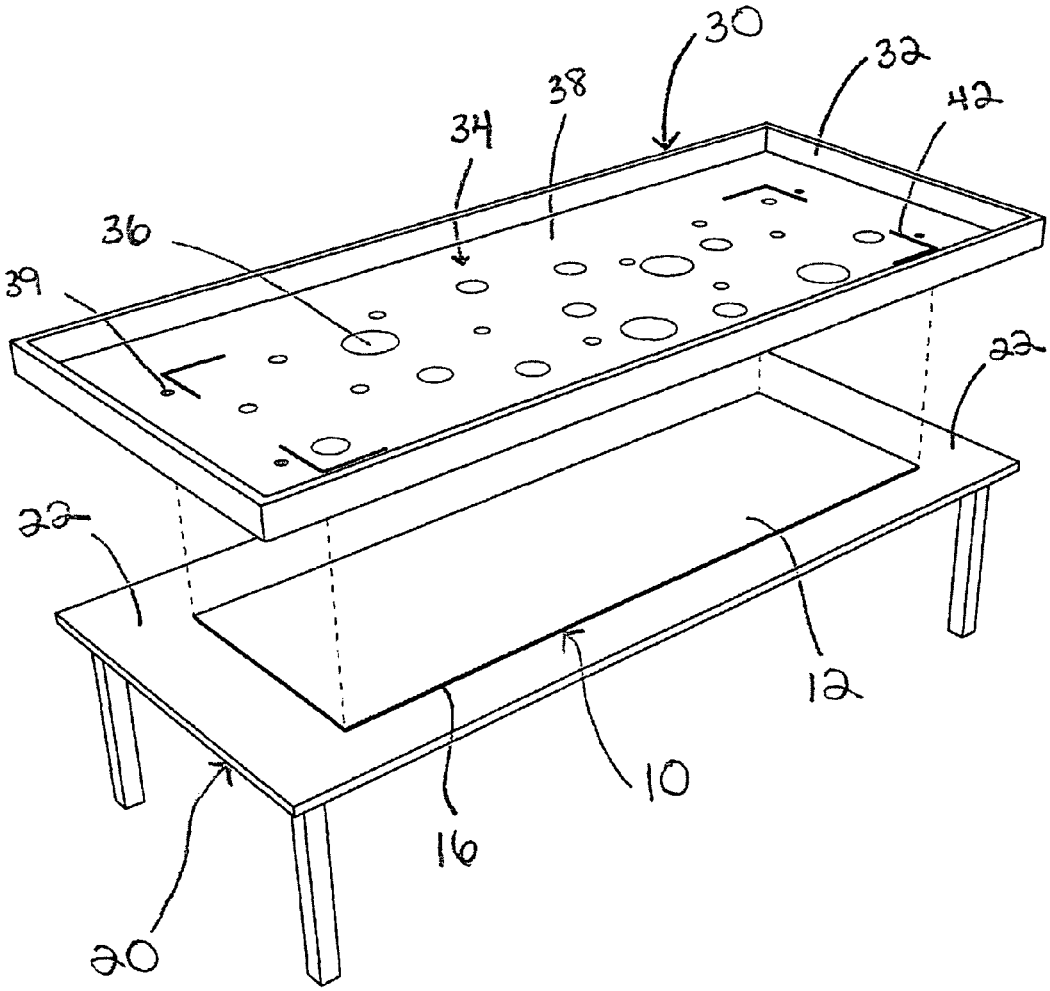
FIGS. 1A-1H illustrate the sequence of process steps for forming the 3-D decorative polymer substrate in accordance with an example embodiment of the invention.

Reference is now made to the drawings wherein similar components bear the same reference numerals throughout the several views.

The present invention extends to a 3-D decorative polymer substrate and a method of forming the polymer substrate without the need to embed objects therein.

Shown throughout the Figures is a rectangular substrate 10 having a first surface 12, a second surface 14 at least substantially opposing the top surface 12 and a circumferential edge surface 16 extending between the top and bottom surfaces. The substrate 10 may be made up of a number of suitable polymers including, but not limited, to polycarbonate, PVC, PMMA, PETG and combinations thereof. The structure can be cast, extruded, calendared, blown, injection molded or formed by any other means known to the polymer and plastics industries. The materials can include variations such as coloring, texturing and frosting, however, the material must be at least somewhat translucent so that a printed image on either the top or bottom surface can be viewed when viewing the panel through the opposing surface.

FIGS. 1A-1D illustrate an exemplary sequence of printing a first screened image onto either the top or bottom surface of a polymer substrate 10. As shown in FIG. 1A, the polymer structure 10 is positioned on a screen supporting structure 20, such as a rectangular stationary layout board or vacuum table, standard in the screen printing industry. The polymer structure 10 is arranged on the supporting structure 20 so that either the first surface 12 or second surface 14 is facing the top surface 22 of the supporting structure 20. For purposes of this description, the surface of the substrate facing the top surface 22 of the support structure in FIGS. 1A-1D is the second surface (not shown in FIGS. 1A-1D).

Figure 1B:
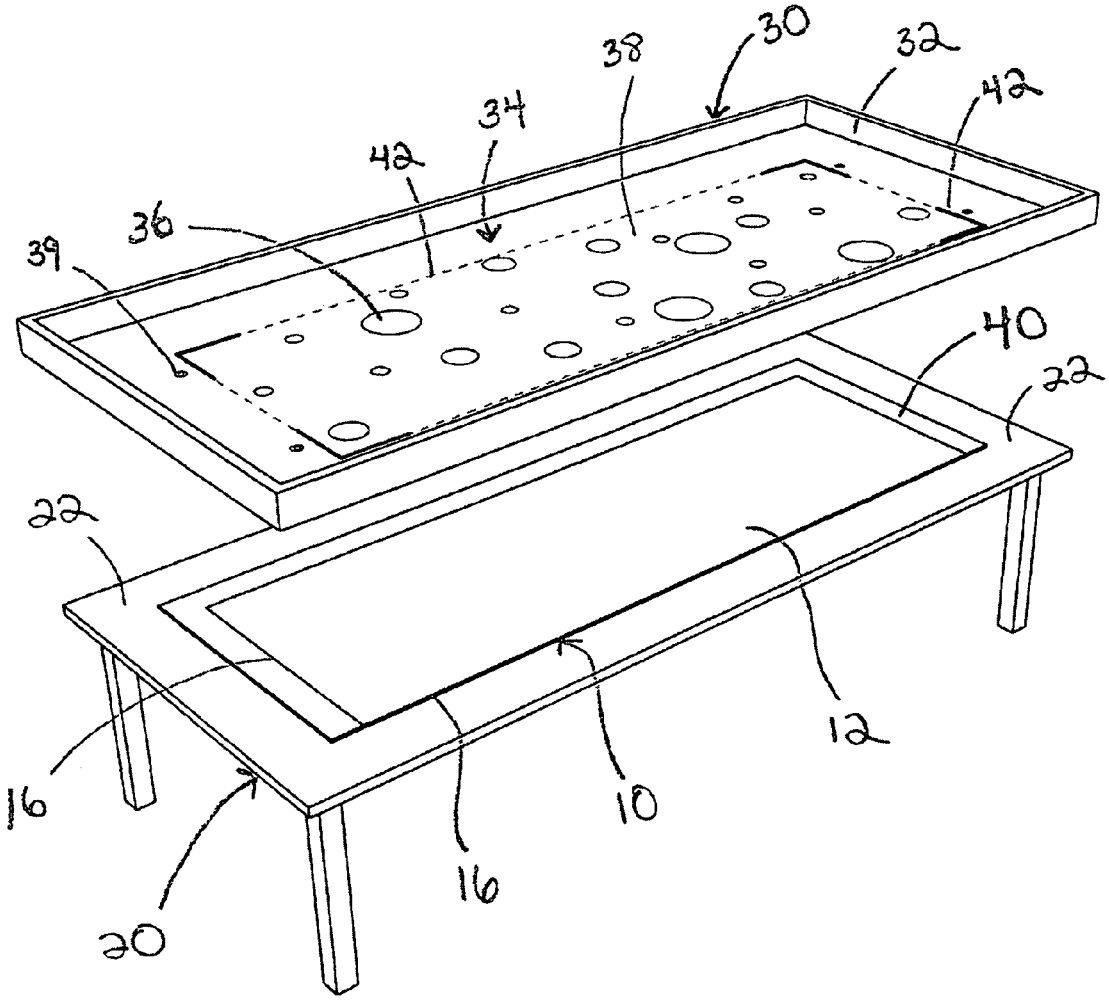

As best shown in FIG. 1B, a registration frame 40 is next positioned on the supporting structure 20 proximate the circumferential edge surface 16 of the polymer structure 10. It is noted that the registration frame can be positioned on and attached to the support structure either before or after the substrate 10 is positioned on the top surface 22 of the support structure 10. In either case, the registration frame 40 preferably contours, at least partially, the circumferential edge surface 16 of the polymer structure 10. The registration frame 40 is then fixedly attached, e.g. taped, glued, etc., to the screen supporting structure 20 to ensure that the frame 40 remains in position. To permit ease of insertion and removal of the substrate 10, the registration frame 40 is not required to cover the entire circumferential edge surface 16 of the polymer substrate 10. For example, in the example embodiment shown throughout the drawings, the registration frame 40 covers three sides of a rectangular polymer substrate 10.

As further illustrated in FIGS. 1A and 1B, a first print screen stencil 30 is positioned over the polymer structure 10 such that the polymer structure interposes the print screen stencil 30 and the top surface 22 of the support structure 10. The print screen stencil 30 includes a screen frame 32 and a screen 34 secured within the screen frame. Conventional screen frames, such as the one shown throughout the drawings, are typically four-sided and are rigid. The screen 34 may be made of any conventional screen fabric used in screen process printing. Typically, the screen 34 has open mesh areas 36 in a predetermined pattern which are adapted to allow a printing composition to pass through the screen 34 and onto the polymer substrate 10 positioned beneath the screen. The typical screen 34 also includes filled or closed mesh areas 38 adapted to prevent the passage of a printing composition. The print screen stencil 30 should be suitable for use with any conventional printing composition such as printing inks, lacquers, metallic powders and pastes.

The screen 34 of the first stencil 30 has four perimeter registration holes 39 which are to be aligned vvith the registration frame 40. As the screen 34 is somewhat transparent, the registration holes 39 can be precisely aligned with the registration frame 40. Optionally, the first screen 34 used in the process can include one or more marks 42 which, due to the transparency, or semi-transparency, of the screen 34, can be aligned precisely with the outer edges of the first surface 12 of the substrate 10. Preferably, the visual of the registration frame 40 contrasts the visual of the polymer substrate 10 for ease in the aforementioned alignment.

Figure 1C:
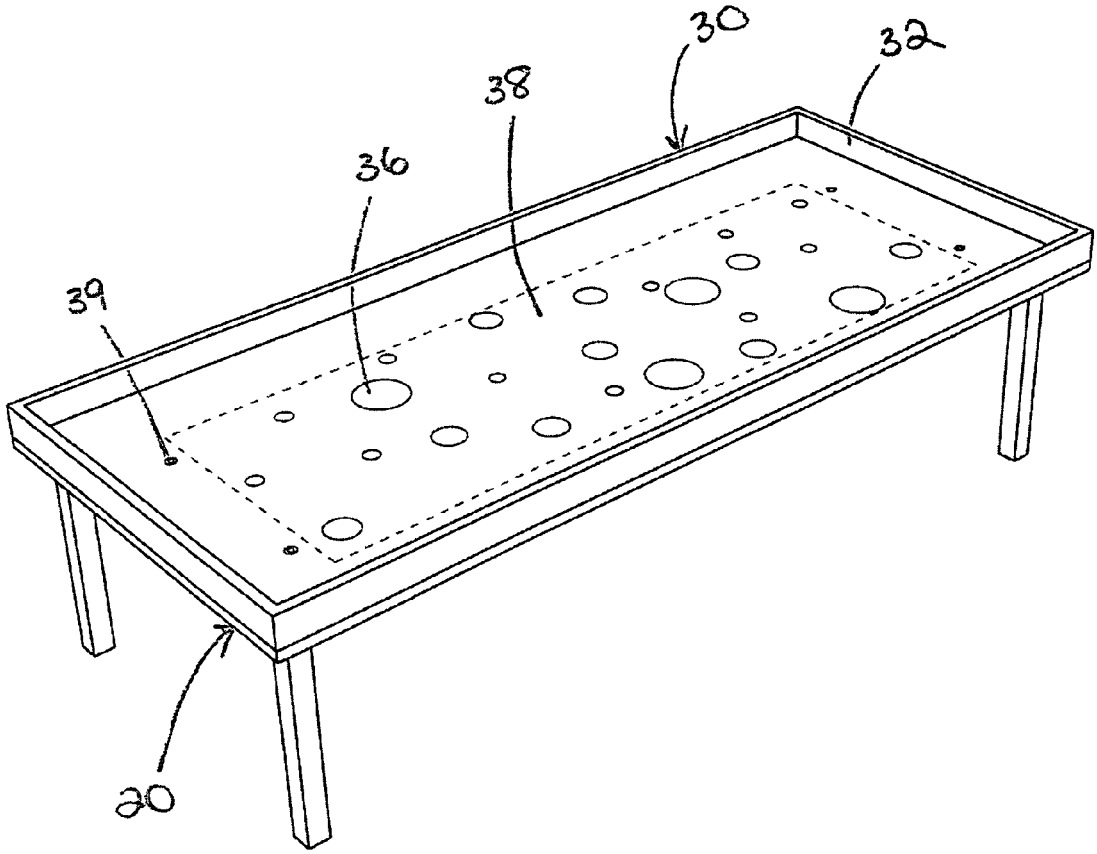
Figure 1D:
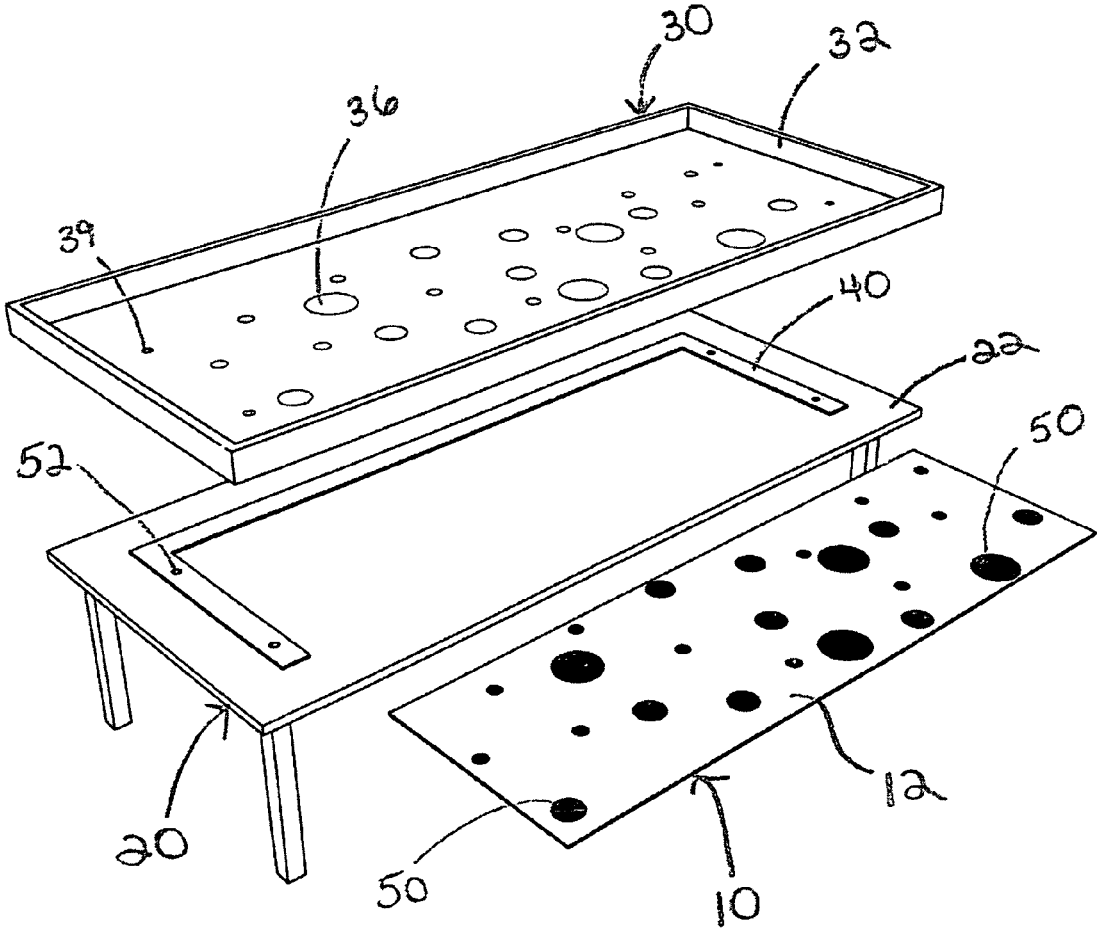

Once the print screen stencil 30 is in proper position as shown in FIG. 1C, a printing composition is applied. More specifically, to form a decorative print on the first surface 12 of the substrate 10, a printing composition is uniformly applied using any suitable means of application such as a squeegee or scoop coater. The printing composition passes through the open mesh areas 36, as well as through the registration holes 39 in the screen 34 causing a decorative print 50 to form on the first surface 12 of the substrate 10 as well as registration marks 52 to form on the registration frame 40. An exemplary resulting printing is shown in FIG. 1D.

The example embodiment shown throughout the Figures incorporates a four point registration system. These registration marks 52 ensure that any subsequent print screen stencil 30 is accurately aligned with any polymer substrate 10 inserted into the registration frame 40, including the opposite side of the substrate shown in FIGS. 1E-1H as will be described in more detail below.

Figure 1E:
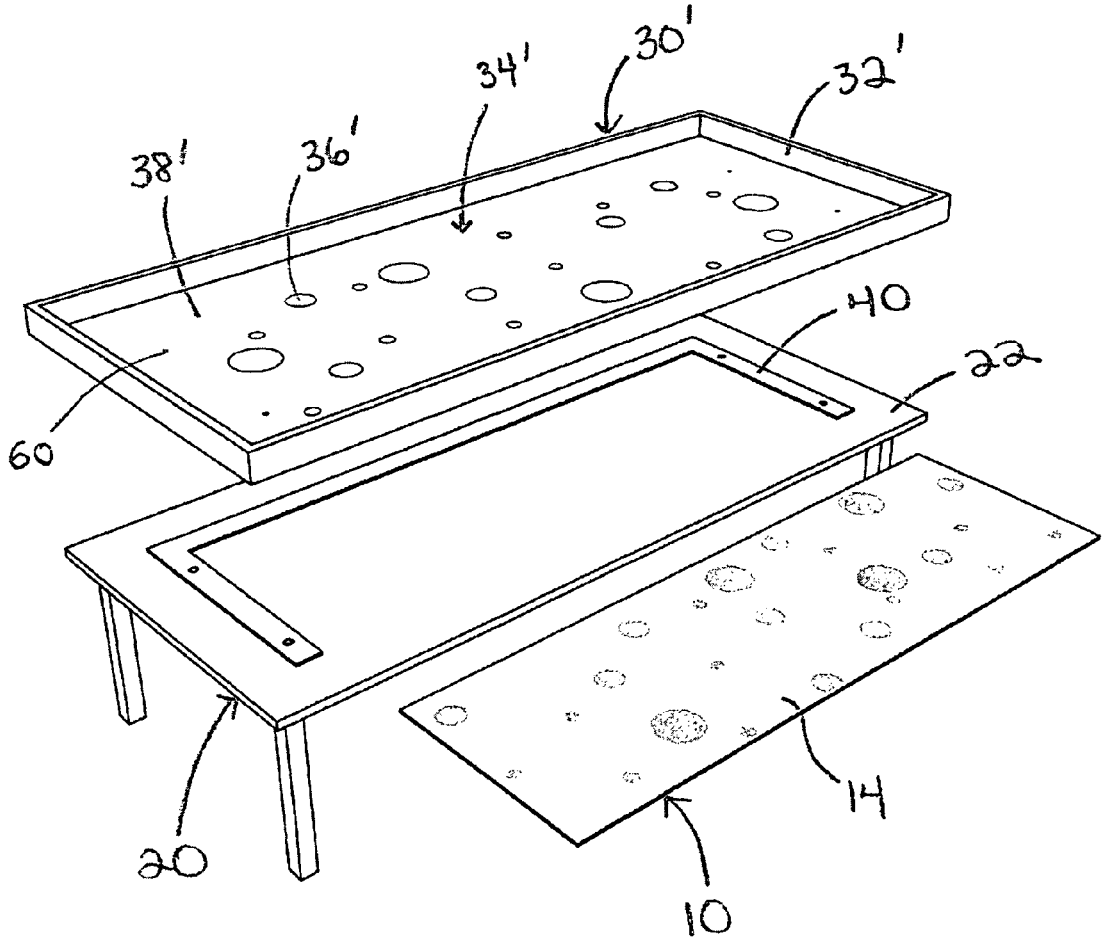
Figure 1F:
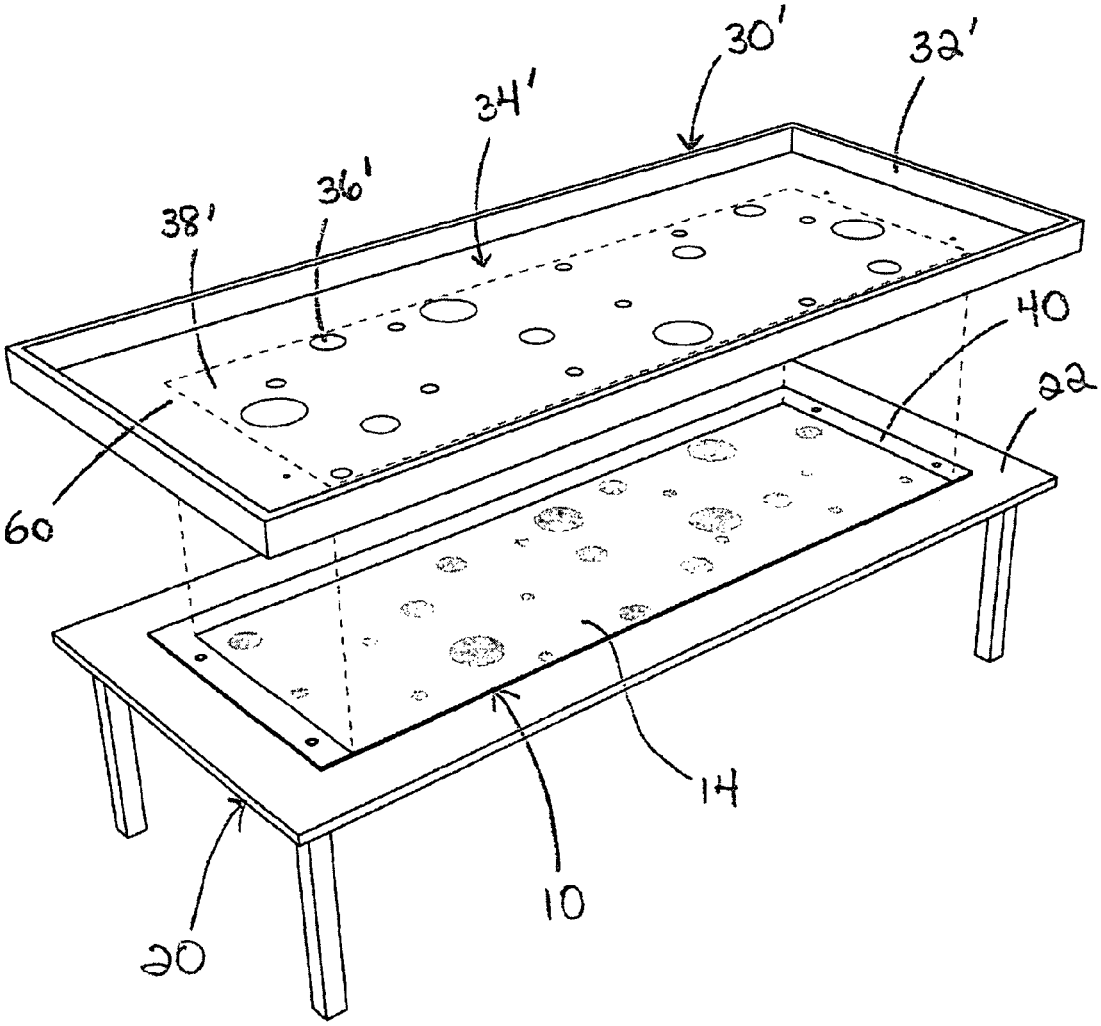

After the printing composition is applied to a first surface 12 of the substrate 10 and allowed to dry, the first print screen stencil 30 is removed (FIG. 1D) and the substrate 10 is flipped over so that the printed first surface 12 faces the top surface 22 of the support structure 20 (FIG. 1E). As shown in FIGS. 1E and 1F, the substrate 10 is reinserted into the registration frame 40 and a second print screen stencil 30' is positioned over the polymer structure 10 such that the polymer structure 10 interposes the print screen stencil 30' and the top surface 22 of the supporting structure 20. The second print screen stencil 30' includes a screen frame 32' and a screen 34' secured within the screen frame. As with the first print screen stencil 30, the screen 34' of the second print screen stencil 30' has open mesh areas 36' in a predetermined pattern which are adapted to allow a printing composition to pass through the screen 34' as well as filled or closed mesh areas 38' adapted to prevent the passage of a printing composition.

Figure 1G:
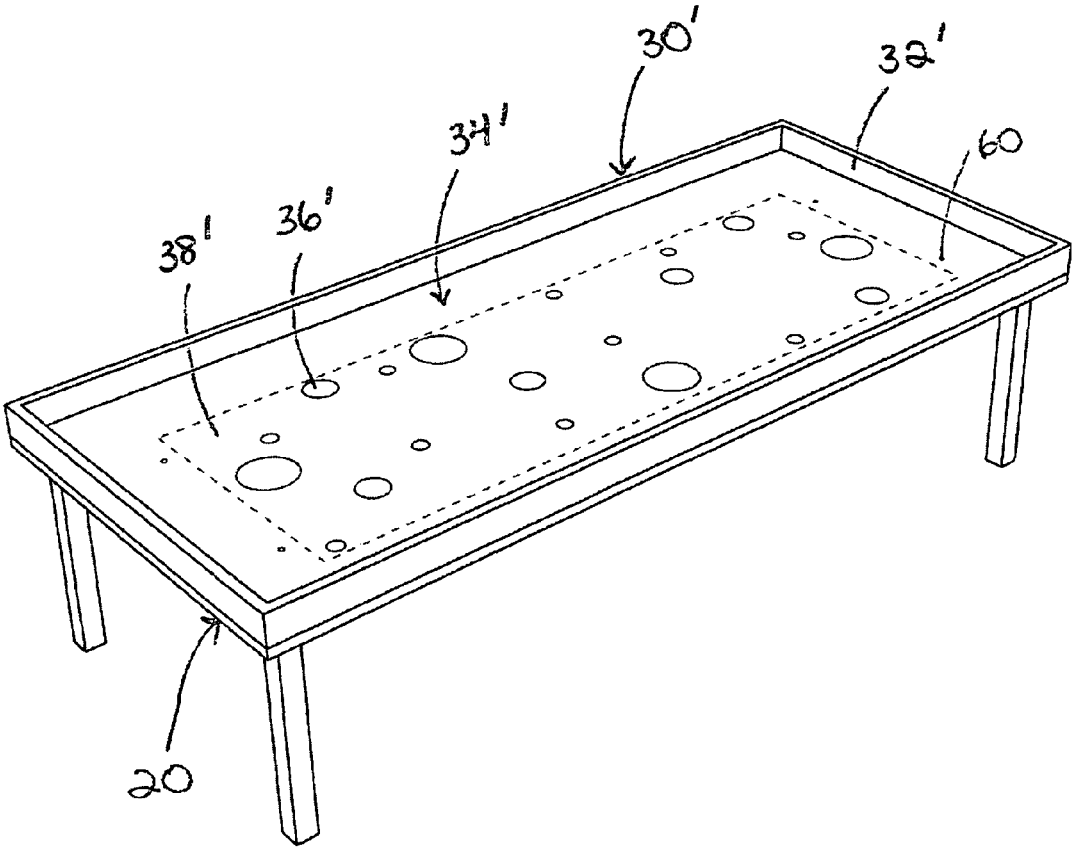
Figure 1H:
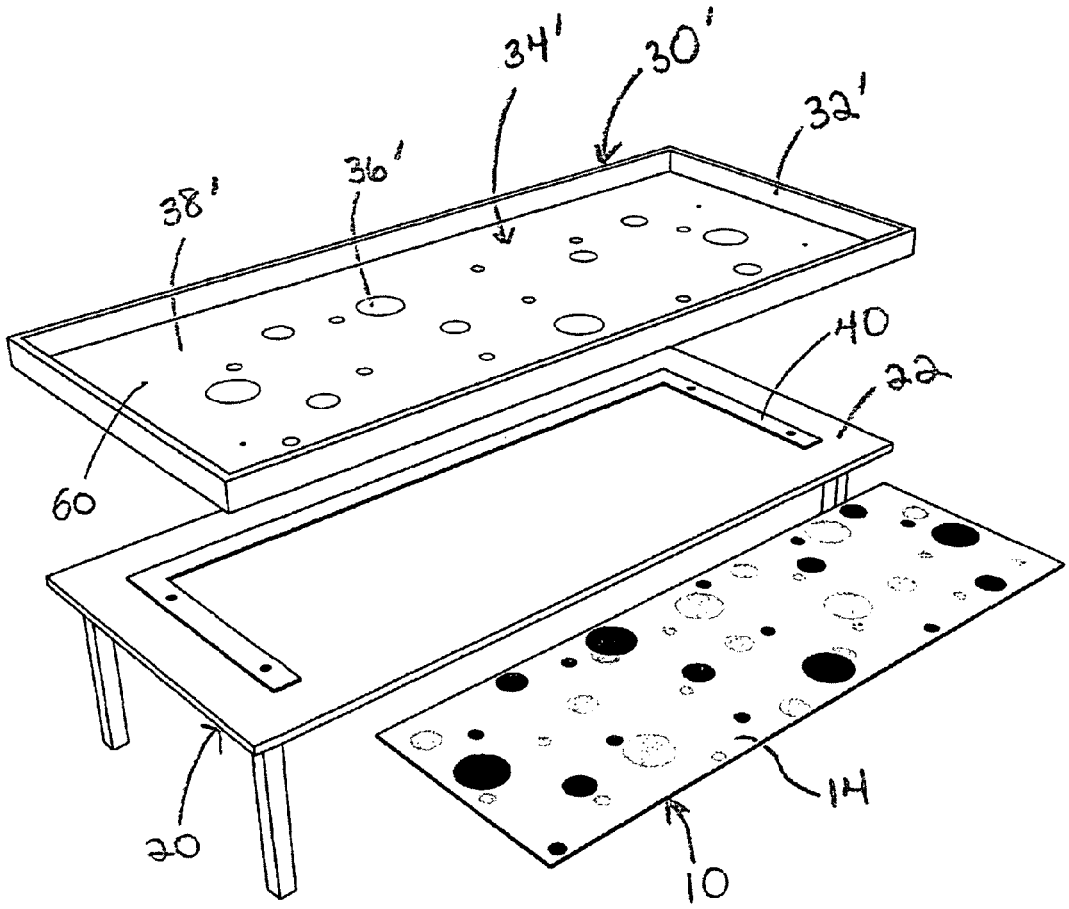

As further shown in FIGS. 1E-1H, the screen 34' of the second stencil 30' has four perimeter registration holes 60 which are to be aligned with the registration markings 52 on the registration frame 40 to ensure registration and complete accuracy. With the second print screen stencil properly positioned as shown in FIG. 1G, a printing composition is then applied and allowed to pass through the open mesh areas 36' in the screen causing a second decorative print 50' to form on the second surface 14 of the substrate 10. The printed substrate is then removed from the support structure as shown in FIG. 1H.

Figure 2:
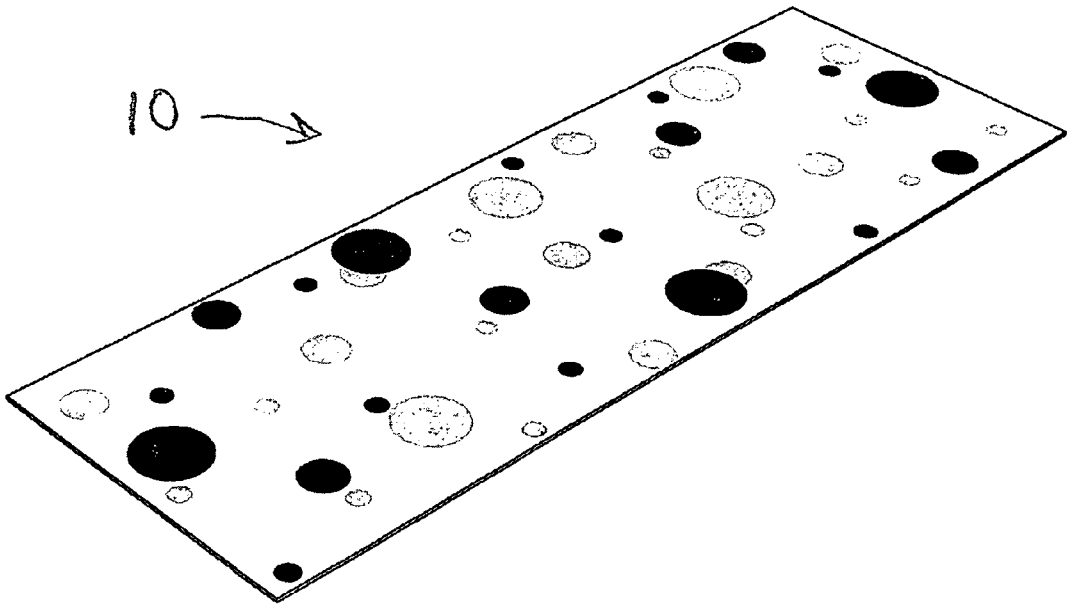
FIG. 2 is a perspective view of an example embodiment of a 3-D decorative polymer substrate in accordance with an example embodiment of the invention.

The orientation of the open mesh areas 36' of the screen 34' shown in FIG. 1E-1H can be in alignment or offset from the orientation of the open mesh areas 36 of screen 34 shown in FIGS. 1A-1D. In the example embodiment shown in Figures, the orientation of the dots of the first and second print screen stencil is different, thereby resulting in the printed dots of the first surface being offset from the printed dots on the second surface of the substrate (best shown in FIG. 2). Since the substrate 10 is made of a translucent or transparent material, the printed patterns on both surfaces can be viewed, at least partially, when viewing the substrate through one of the surfaces. As a result of the printing of patterns on opposing sides of the substrate, a three-dimensional visual is created.

The above description of the invention is provided as an enabling teaching of the invention in its best, currently known embodiment. It will be understood by those of skill in the art that variations on the embodiments set forth herein are possible and within the scope of the present invention. The embodiments set forth above and many other additions, deletions, and modifications may be made by those of skill in the art without departing from the spirit and scope of the invention. For example, the registration holes 60 on the screen can be located within the boundaries of the printed design and, thus, form part of the printed design. In addition, the registration frame 40 can be open or close ended so long as the frame provides sufficient framing of for the substrate to be inserted and positioned consistently in the frame. With respect to the substrate itself, the thickness of the circumferential edge 16 can be varied to create different three-dimensional visuals using the same set of two printed designs, such as the set of two dot designs shown throughout the Figures.

We claim:

1. A method of registering the decorative prints on opposing surfaces of a substrate, the method comprising the steps of:

providing a substrate having first and second surfaces and a circumferential edge surface extending therebetween, wherein at least a portion of the second surface is visible when the substrate is viewed through the first surface;

arranging the substrate on a supporting structure with the second surface of the substrate facing the supporting structure, the supporting structure having a registration frame secured thereto;

positioning the circumferential edge surface of the substrate proximate and in contact with the registration frame;

providing a first print screen stencil having a top and bottom surface and two or more registration holes extending through the top and bottom surfaces:

positioning the first print screen stencil above the substrate and registration frame so that the at least two of the registration holes are aligned with the registration frame;

applying a printing composition to a top surface of the first print screen stencil to produce a printed design on the first surface of substrate and at least two printed registration marks on the registration frame;

removing the first print screen stencil from above the substrate and registration frame;

turning the substrate over so that the first surface of the substrate is facing the supporting structure;

positioning the circumferential edge surface of the substrate proximate and in contact with the registration frame;

providing a second print screen stencil having a top and bottom surface and two or more registration holes extending through the top and bottom surfaces;

positioning the second print screen stencil above the substrate and registration frame such that at least two registration holes of the second screen stencil are aligned with the printed registration marks on the frame;

applying a printing composition to a top surface of the second print screen stencil to produce a printed design on the second surface of the substrate; and removing the second print screen stencil from above the substrate and registration frame, whereby a consistent three dimensional visual can be provided by two or more substrates.

2. The method of claim 1, wherein the substrate is a polymer substrate.

3. The method of claim 1, wherein the substrate is translucent.

4. The method of claim 1, wherein the first print screen stencil comprises a silk screen.

5. The method of claim 1, wherein the first print screen stencil includes open mesh areas in a predetermined pattern which are adapted to allow a printing composition to pass through the screen stencil and onto the first surface of the substrate.

6. The method of claim 1, wherein the first and second surfaces of the substrate are opposing flat surfaces.

7. The method of claim 1, wherein the two registration holes on the screen can be located within the boundaries of the printed design.

8. The method of claim 1, wherein the two registration holes are screened holes.

9. The method of claim 1, wherein the registration frame is open ended and provides sufficient framing for the substrate to be inserted and positioned consistently in the registration frame.

* * * * *